US005528629A

United States Patent [19]

van der Krogt et al.

[11] Patent Number: 5,528,629

[45] Date of Patent: Jun. 18, 1996

[54] METHOD AND DEVICE FOR CODING AN ANALOG SIGNAL HAVING A REPETITIVE NATURE UTILIZING OVER SAMPLING TO SIMPLIFY CODING

[75] Inventors: Adrianus A. M. van der Krogt, Voorschoten; Robertus L. A. van Ravesteiin, Voorburg, both of Netherlands

[73] Assignee: Koninklijke PTT Nederland N.V., Groningen, Netherlands

[21] Appl. No.: 400,263

[22] Filed: Mar. 2, 1995

Related U.S. Application Data

[63] Continuation of Ser. No. 298,374, Aug. 30, 1994, abandoned, which is a continuation of Ser. No. 150,589, Nov. 10, 1993, abandoned, which is a continuation of Ser. No. 27,919, Mar. 8, 1993, abandoned, which is a continuation-in-part of Ser. No. 750,818, Aug. 27, 1991, abandoned.

[30] Foreign Application Priority Data

Sep. 10, 1990 [NL] Netherlands ..... 9001985

[51] Int. Cl.[6] ..... G10L 9/14

[52] U.S. Cl. ..... 375/244; 375/241; 341/76; 341/143; 348/410

[58] Field of Search ..... 375/241, 242, 375/244, 250; 370/118; 341/76–77, 106, 143; 348/410, 421, 422; 381/29–30

[56] References Cited

U.S. PATENT DOCUMENTS

| | | | |
|---|---|---|---|
| 4,706,260 | 11/1987 | Fedele et al. | 375/245 |
| 4,933,957 | 6/1990 | Bottan et al. | 375/244 |
| 5,125,030 | 6/1992 | Nomura et al. | 381/30 |

FOREIGN PATENT DOCUMENTS

| | | |
|---|---|---|
| 0280827A1 | 9/1988 | European Pat. Off. . |
| 2061071 | 5/1981 | United Kingdom . |

OTHER PUBLICATIONS

J. S. Marques, et al, Pitch Predition with Fractional Delays In Celp Coding, Sep. 1989, pp. 1–4, European Conference on Speech Communication and Technology, Paris.

Von Peter Vary et al, Speech Codec for the European Mobile Radio System, 1988, pp. 85–93, Sprachcodec für das Europäische Funkfernsprechnetz.

ICASSP '86, IEE–IECEJ–ASJ International Conference on Acoustics, Speech, and Signal Processing, Tokyo, 7–11 Apr. 1986, vol. 3, IEEE, (New York, US), T. Miyamoto et al: "Single DSP 8KPBS Speech Codec", pp. 1717–1720.

*Primary Examiner*—Young Tse

*Attorney, Agent, or Firm*—Frishauf, Holtz, Goodman, Langer & Chick

[57] ABSTRACT

Speech signals coded according to the principle of high-resolution long-term prediction (HLTP) have a high accuracy due to the high-resolution which causes a high complexity. The ordinary LTP method is improved by use of oversampling and determining subsegments Cd lying in a preceding segment which precedes a subsegment to be coded, for which it is the case that the number of samples Dd, expressed in the numbers of samples after oversampling, between the initial time instant of the subsegment to be coded and the initial time instant of a subsegment Cd, fulfills the relation Dd=(D*Ob)/d, in which d=2,3,4 . . . n, where n is a positive integer and where Ob and n are chosen in a manner such that Dd is always an integer. Null sample values produced initially for oversampling are given significance by means of an interpolation technique, at predetermined positions which are situated at a spacing Dd from the original samples in the subsegment to be coded. In the oversampling the number of samples in the subsegment to be coded is increased by a predetermined factor Ob by always placing (Ob-1) samples having a value equal to 0 between two consecutive samples, and the number of samples in the preceding segment, which contains the selectable subsegments Cd, is also increased by the factor Ob.

5 Claims, 5 Drawing Sheets

METHOD AND DEVICE FOR CODING AN ANALOG SIGNAL HAVING A REPETITIVE NATURE UTILIZING OVER SAMPLING TO SIMPLIFY CODING

This application is a Continuation of application Ser. No. 08/298,374, filed Aug. 30, 1993 (abandoned), which is a Continuation of Ser. No. 08/150,589, filed Nov. 10, 1993 (abandoned), which is a continuation of Ser. No. 07/027, 919, filed Mar. 8, 1993 (abandoned), which is a Continuation-In-Part of Ser. No. 07/750,818, filed Aug. 27, 1991 (abandoned).

The invention relates to a method for coding a sampled analog signal having a repetitive nature, in which, for a signal segment to be coded consisting of a predetermined first number of samples, a search is always made in a preceding segment containing a predetermined second number of samples which is greater than the first number of samples for a signal segment which is as similar as possible by always comparing the signal segment to be coded, in steps of one sample interval, with a segment containing the first number of samples which forms part of the segment containing the second number of samples, and in which the difference signal is determined between the found, most similar segment and the segment to be coded as well as the difference between a reference time instant in the segment to be coded and a reference time instant in the found, most similar segment, expressed in the number of samples D between the two time instants.

BACKGROUND AND PRIOR ART

It is known that analog signals having a strongly consistent nature such as, for example, speech signals can be coded after sampling in an efficient manner by consecutively carrying out a number of different transformations on consecutive segments of the signal which each have a particular time duration. One of the known transformations for this purpose is linear predictive coding (LPC), for an explanation of which a reference can be made to the book entitled "Digital Processing of Speech Signals" by L. R. Rabiner and R. W. Schafer; Prentice Hall, New Jersey; chapter 8 which chapter is hereby incorporated by reference into this specification. As stated, LPC is always used for signal segments having a particular time duration, in the case of speech signals, for example, 20 ms, and is considered as short-term coding. It is also known to make use not only of a short-term prediction but also of long-term prediction (LTP), in which a very efficient coding is obtained by a combination of these two techniques. The principle of LTP is described in Frequenz (Frequency), volume 42, no. 2-3, 1988; pages 85–93; P. Vary et al.: "Sprachcodec für dass Europäische Funkfernsprechnetz" ("Speech Coder/Decoder for the European Radio Telephone Network").

In LTP, for a signal segment to be coded, a search is made for a segment with the greatest possible similarity in a signal period, preceding the said segment, having a particular duration. Then a signal which is representative of the difference between the segment to be coded and the found segment, and also a signal which is representative of the time duration which has elapsed since the found segment, is transmitted in coded form, which can result in an appreciable reduction of the information to be transmitted. Because the basic principle of LTP does not appear to result in all cases in finding a signal segment with optimum similarity, an improvement of the LTP principle has been proposed under the name HLTP (high-resolution LTP). A possible implementation of HLTP is described in Eurospeech 89, European Conference on Speech Communication and Technology, Paris, September 1989, in the article entitled "Pitch Prediction with Fractional Delays in CELP coding" by J. S. Marques et al., which is hereby incorporated by reference into this specification. In the case of HLTP, the chance that the signal segment with the greatest similarity is found is increased by an increase in the sampling frequency of the preceding signal period by means of interpolation. A draw-back of HLTP is, however, that, as will be explained in greater detail below, the complexity of the coding is much greater than in the case of LTP as a result of an appreciable increase in the number of operations.

SUMMARY OF THE INVENTION

The object of the invention is to provide a method in which an improvement in the LTP principle is obtained in that the chance that the segment with the greatest similarity in a preceding period having a particular duration is found increases considerably, without increasing the number of operations needed in doing this to the same extent as in the case of HLTP.

For this purpose, the invention provides a method of the above type, characterized in that the number of samples in a segment to be coded is increased by a pre-determined factor Ob by always placing (Ob−1) samples having a value equal to 0 between two consecutive samples (oversampling), in that the number of samples in a preceding segment is also increased by the factor Ob, in that, in the preceding segment, subsegments Cd are determined for which it is the case that the number of samples Dd, expressed in the numbers of samples after oversampling, between the reference time instant in the segment to be coded and the reference time instant in a subsegments Cd fulfils: $Dd=(D * Ob)/d$, in which $d=2, 3, 4 \ldots n$, where n is a positive integer, and Ob and n are chosen in a manner such that Dd is always an integer, in that, in the subsegments Cd, sample values are determined by an interpolation technique at predetermined positions, which predetermined positions are situated at a spacing Dd from the original samples in the segment to be coded before its number of samples was increased, and in that a partial segment Cd is determined which is the most similar to the segment to be coded.

Attention is called to the method of notation in the foregoing paragraph. The term Dd does not designate the multiplication of D×d and the symbol d has the same effect as if it were a subscript meaning that it is a value of D which depends upon the value of d. The same applies to the term Ob, although in that case they are not different values of 0 that are used in the same calculation. The term Dd for a particular case may be referred to as D2 for the case of d=2 and so on. As for the subsegment Cd, of course this is evidently a designation of a particular subsegment C. The apparatus of the invention provides, in particular, two calculating units which are part of an LTP encoder, which in turn cooperates with a linear (short term) predictive (LPC) encoding system. Combined LPC and LTP encoders and decoders are well known. The LTP encoder, in its heretofore known portions supplies, to the first calculating unit characterizing the invention, a value D of the number of samples of a known sampling rate, for example (8 kHz), between a reference time instant in the segment to be coded and a reference time instant in a prior segment found to be similar to the segment to be coded by the LTP encoder. It contains a register which stores the value Ob and a multiplier circuit for multiplying D by Ob. It also has a generator of successive values of d 2,3, . . . ,n and a register for the number n which is the maximal number of d. Finally there is a dividing circuit to which the output D*Ob of the multiplier circuit is supplied as a dividend and to which the output d of the d generator is supplied as the divisor. The output of the first calculating unit is accordingly (D*Ob)/d, where d=2, 3, . . . n. These output values are collectively referred to as Dd and can be individually identified as D2,D3, . . . ,Dn. This output goes to the second calculating unit which is supplied with the signal segment B, which has been split off for the purposes of the LTP coder and is a relatively long segment that preceded the segment A which is to be compared to various parts of the segment B.

The successive values D1,D2 . . . Dn are supplied to a second calculating unit, in which a fixed number of samples of the segment B stored in a buffer memory, bridging an address in that memory determined by the particular value D1, are read out into a buffer, the output of which is connected to an interpolating unit. The interpolating unit, which may be a read-only memory, produces the interpolation value belonging to the samples and the interpolation value is then stored in a buffer which continues to be filled until 40 interpolation values are stored, those being together a subsegment, for example, C2 corresponding to the input D2 at the second calculating unit.

The value Dd=D*Ob/d is supplied to a correcting unit of the second calculator which adds a correction value Sd in such a way that the value of (Dd+Sd) is a multiple of the value Ob. Sd is then supplied both to the interpolator and to the portion of the second calculating unit which provides an address for the buffer memory which address defines samples of a subsegment of segment B which are to be supplied to the interpolator.

The interpolation values constituting each of the various subsegments C shifted in time within the segment B are submitted to a calculating circuit (similar to that used in HLTP) to which the segment A is provided for determining degree of similarity between segment A and the various shifted subsegments C. The output of that circuit is then correlated as to the degree of similarity with the LTP-selected subsegment C. Those assessments are correlated to determine the value of D which relates to the optimal subsegment C. That value of D is transmitted as an output of the encoder. The inverse takes place in a decoder, but much more simply, since the optimal subsegment C having the same length as the segment A has already been identified.

BRIEF DESCRIPTION OF THE DRAWINGS

The invention will be explained in greater detail below with reference to the drawing, wherein.

DESCRIPTION OF THE METHOD OF THE INVENTION

Figure 1A:
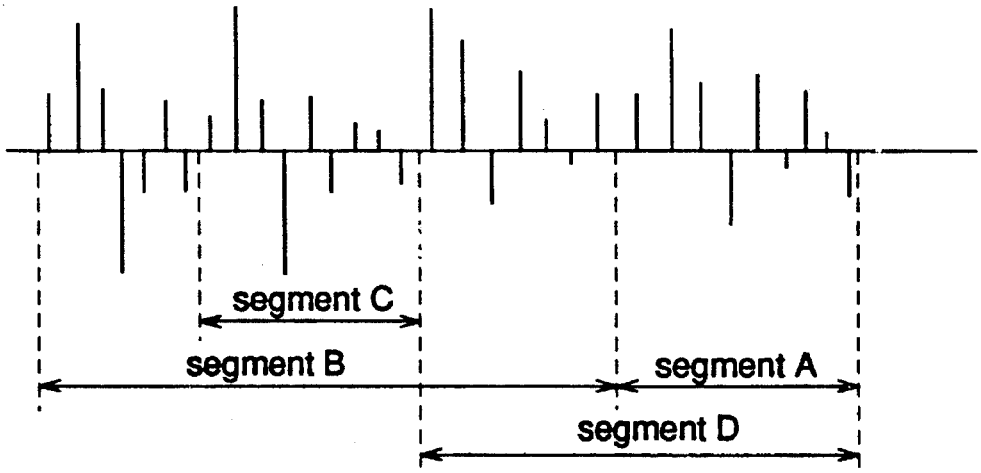
FIG. 1*a*–1*c* show various signal forms to explain the LTP principle and the difficulties associated therewith.
Figure 1B:
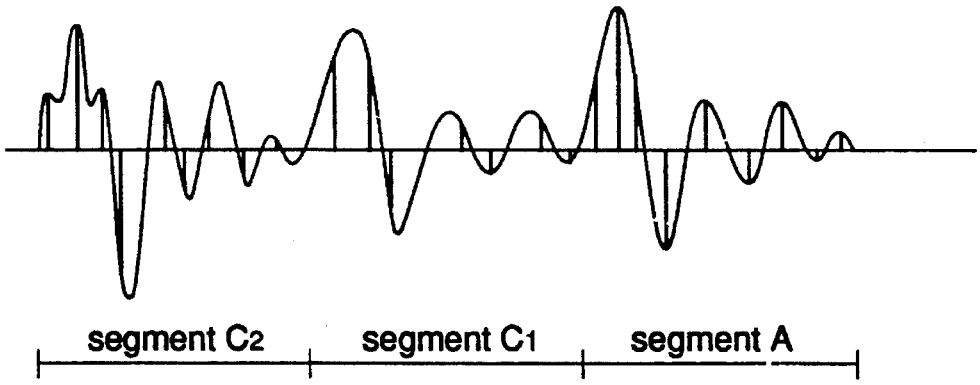
Figure 1C:
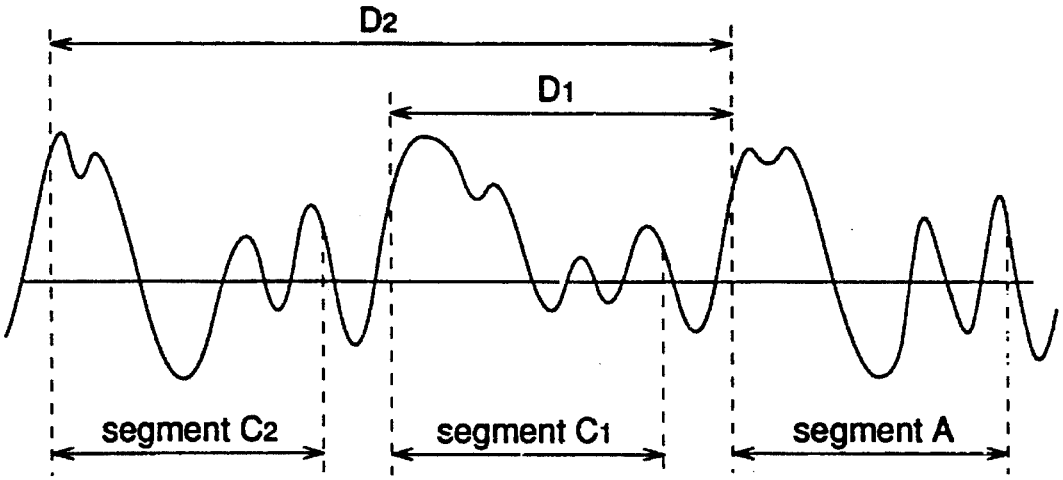

FIG. 1*a* shows, in the time domain, an example of the sampled version of a signal having a strongly repetitive nature, such as a speech signal. To explain the principles of LTP and HLTP it will be assumed that, before a subsegment having a duration of 5 ms is selected, a search is always made in a preceding period of 15 ms for the subsegment of likewise 5 ms having the greatest similarity to a current signal to be coded and that the sampling frequency is 8 kHz. The 5 ms subsegment to be coded in this connection will be termed segment A, the segment of the period of 15 ms will be segment of B and the wanted segment with the greatest similarity will be subsegment C. The term "subsegment" is applied here systematically to 5 ms sequences of samples and the term "segment" is used to designate 15 ms sequences of samples in the example here described and illustrated in FIGS. 1*a*, 1*b* and 1*c*. FIGS. 1*a* and 1*c*, for simplifying the drawings, do not show subsegment C and segment B, for example, on the same time scale. These segments and subsegment are shown in FIG. 1*a*. Now the principle of LTP is that, before the transmission of segment A, no signals are transmitted which are directly related to the samples in segment A, but firstly signals which are related to the sample values which are produced if the difference signal between segment A and segment A of the same length as the subsegment A is determined, and in the second place, signals which are related to the time difference between segment A and subsegment C, expressed, for example, in the number of samples D between the beginning of segment A and the beginning of subsegment C. In a decoder which receives said transmitted signal, the segment A can now be formed because subsegment C is in principle already known in the decoder, for example because the samples over the preceding 15 ms are always stored in a memory so that the samples from the segment can be read out of the memory with the received signal which is representative of the difference D in number of samples between the beginning of the subsegments A and C, after which the segment A can be formed with the signal, also received, which is representative of the difference between the sample values of segment A and subsegment C.

The complexity of the LTP principle can be defined as follows. In segment A, 40 samples are present, and in subsegment B 120 samples. The segment B therefore has to be investigated in 81 steps by "shifting" the entire segment A in steps equal to a sample interval over subsegment B and at every step determining the degree of agreement, expressed in a correlation value, by means of correlation techniques. Said correlation value R(k) can be calculated by means of the formula:

$$R(k) = \sum_{m=o}^{N-1} A(m) \cdot B(m+k) \tag{1}$$

where:

N=40, the number of samples in segment A;

k=0 . . . 80, the starting value of a subsegment (a possible subsegment C) within subsegment B; and m=the sample number within segment A.

For a more detailed explanation of this correlation technique, reference can be made to page 147 of the abovementioned book by L. R. Rabiner. Of course, other correlation techniques can also be used in principle, as well as other techniques for determining the agreement between two groups of sample values, which other techniques are deemed to fall within the definition of correlation.

To calculate the correlation value, 40 multiplications and 39 additions are necessary for each value of k, so that the total number of operations required is equal to: 81 * 79=6399.

As has already been stated above, a problem in using the LTP principle is that the subsegment C with the greatest similarity to segment A cannot always be found. This is shown diagrammatically in FIG. 1*b*, from which it is evident that, in terms of signal form (the envelope of the samples), the subsegment C1 shows the greatest similarity to the segment A, but the sample values of subsegment C2 shows the greatest similarity to those of segment A so that subsegment C2 is incorrectly chosen as the most suitable subsegment of subtraction from segment A to form a difference signal. The HLTP principle effects an improvement in this because the sampling frequency in the subsegment B has been increased, for example, by a factor of 12. This increases the chance that the correct subsegment C is found. As has already been stated, this takes place at the expense of an appreciable increase in the complexity, as can be calculated as follows: the sampling frequency of segment B is increased by means of interpolation techniques by a factor of 12, it being assumed that every intermediate sample is calculated from 7 already known samples.

The segment B will now contain 12 * 120=1440 samples. To calculate the intermediate samples, (120 * 11) * 7=9240 multiplications are necessary and (120 * 11) * 6=7920 additions, that is to say 17160 operations.

The sampling frequency of segment A is also increased by a factor of 12 by always inserting 11 samples having a value=0 between two subsequent known samples. The subsegment B of 1440 samples now has to be searched in 961 steps by again shifting segment A over segment B. In calculating the correlation value R(k), the above formula explained for the LTP principle can be used. At the same time, it is not necessary to calculate a correlation value also for the intermediate sample values, so that for every value of k (k=0 . . . 960) 79 operations are necessary, just as in the case of LTP.

The total number of operations needed in HLTP is therefore (961 * 79)+17160=93097.

This means that, with the abovementioned (real) assumptions for the increase in the sampling frequency and the manner of interpolation, the complexity of the HLTP principle is approximately 14.5 times as complex as the LTP principle.

In the example of the HLTP principle described, the spacing D between the beginning of subsegment A and the beginning of the segment C found can again be expressed in the number of samples between the two time instants (not more than 961) and can thus be reproduced in 10 bits.

According to the invention, the subsegment C with the greatest similarity is sought in the manner to be described below, which is less complex than the HLTP principle, the chance that the subsegment found is actually the subsegment with the greatest similarity to the subsegment A being appreciably greater than in the case of the LTP principle.

According to the invention, the subsegment C having the greatest similarity to the segment A is first sought, according to the LTP principle explained above, in a longer segment B preceding a segment A to be coded. This subsegment C is situated at a number D of samples from the segment A. According to the invention, the sampling frequency is then also increased by a factor of Ob, for example also by a factor of Ob=12. As a result of this, the found subsegment C ends up at a spacing equal to (D * Ob) from segment A. After that, whether a subsegment Cd at a spacing of Dd=(D * Ob)/d from segment A may possibly show more similarity to segment A than the subsegment C found with the aid of the LTP technique for the value d=2 (which will therefore hereinafter be termed C2) is determined. Possible values of d are: d=2, 3, 4 . . . .

For these values of d an investigation can be made of whether a subsegment Cd agrees better with segment A than the subsegment C2. That possibility follows from the relative lengths of the subsegments A and segment B. The found value of d at which the best agreement is observed is denoted by donoted by $d_{optimum}$.

The complexity of the method according to the invention with respect to that of LTP and HLTP can be calculated as follows:

In the method according to the invention, if the same respective time durations of the segment A and the segment B (5 and 15 ms, respectively) and the same sampling frequency (8 kHz) is assumed as in the example of the LTP principle described above, 6399 operations are necessary to find the subsegment C2.

To seek the subsegment Cd with d=2, 3 and 4 in the present example, the sampling frequency is increased by a factor of 12, for example by always placing 11 sample values equal to 0 between two consecutive known samples and by only calculating the actual sample value for samples at predetermined time positions determined by values of d, for example by means of interpolating 7 already known samples. These pre-determined positions are the positions of the samples which are situated at a spacing Dd from the original samples in the segment A. The sampling frequency of the segment A is also increased and, just as in the case of HLTP, this is done by always placing 11 samples having a value equal to 0 between two known samples. Segment A therefore consists of 480 samples, of which a maximum of 40 are not equal to 0. As a result of this, in principle, only a maximum of 40 intermediate sample values need to be calculated by interpolation in subsegment Cd and not, as in the case of HLTP, 440 intermediate values. Only a maximum of 40 * (7 multiplications+6 additions)=520 operations are therefore necessary for each subsegment Cd to calculate the intermediate sample values by means of interpolation dependent on seven known values. This therefore means 1560 operations for 3 subsegments Cd. The actual comparison of the subsegment A with the subsegment Cd by means of the correlation technique explained above requires for each segment Cd: 40 multiplications+39 additions=79 operations. That is to say, for 3 segments Cd: 237 operations.

The total number of operations needed to determine the subsegment C1 and the subsequent comparison of 3 possibly suitable segments Cd with segment A is, with the method according to the invention, therefore 6399+1560+237=8197. If determined values of Dd are divisible by 12, this means that the associated subsegments Cd have already been investigated in the first search procedure according to the LTP principle, so that this does not need to be done again. In such a case, the number of operations needed is therefore less than 8197.

It will be clear that, with the method according to the invention, an appreciable simplification is obtained with respect to the HLTP principle, while the chance that the most similar subsegment C is found is nevertheless appreciably greater than in the case of the LTP principle. Even if subsegments Cd were to be investigated for greater values of d than 4 in the case of, for example, other lengths of segment A and subsegment B, the method according to the invention remains simpler than that according to the HLTP principle. Once the subsegment Cd with the greatest similarity has been found and $d_{optimum}$ is therefore known, the Dd associated therewith can also be calculated. In the example, the value of Dd may be situated between 2 and 120 and that of $d_{optimum}$ between 2 and 4, so that a total of not more than 9 bits are necessary to transmit these two values, which is again more efficient than in the case of HLTP.

According to a further aspect of the invention, to increase the chance further that the most similar subsegment C is found, subsegments Cd at spacings of Dd=(D * Ob)/d +eps are also examined, where eps=−(Ob−1), . . . , −2, −1, 1, 2, . . . (Ob−1) or a portion of these values; in practice, the values eps=−2, −1, 1, 2 are, for example, sufficient. Even if the HLTP principle is used, the situation may arise which is shown in FIG. 1*c*. The subsegment C2 appears to show more resemblance to the subsegment A than the subsegment C1 situated nearer the segment A. More detailed analysis shows, however, that this latter subsegment is in fact the wanted subsegment because the fundamental regularity P which is present in the signal and which, for example in the case of speech, is determined by the fundamental frequency of the vocal cords, is determined by the spacing D1 between subsegment A and subsegment C1 and not by the spacing D2 between segment A and subsegment C2. This phenomenon may be due, for example, to the presence of noise. Similarly, if a subsegment C3 or C4 may at first show more resemblance to the segment A, a further analysis may reveal a greater resemblance in C2.

It is important that the fundamental regularity P in the signal is found as often as possible every time a subsegment C is sought because at the location where the transmitted coded signal is decoded, this regularity, expressed in the spacing D, is again provided in the decoded signal by the decoder. If this regularity is disturbed too often between consecutive coded subsegments, this results in undesirable interferences in the decoded signal. Said interference is a known problem in HLTP and in LTP.

In order to offer a solution for this as well, according to a further aspect of the invention, after the subsegment Cd with the greatest similarity has been found with the aid of the method described above, which is established in that the highest value is found for that subsegment in calculating the correlation value Rd with the aid of formula (1), hereinafter to be termed $R_{max}$, it is investigated whether there are subsegments Cd which are situated at a smaller spacing D from the segment A and have a correlation value Rd which is greater then q * $R_{max}$, where q<1, for example q=0.8. Of all the subsegments Cd, the correlation value Rd of which fulfils this condition, the subsegment Cd which is situated nearest segment A, that is to say the subsegment having the smallest value for D, is then chosen as the most suitable subsegment, despite the fact that there are one or more subsegments with greater similarity. This choice is based on the insight that such a subsegment C situated nearer segment A is most probably the correct one because of the smaller value of D in view of the specific properties of the (speech) signal to be coded. If none of the subsegments Cd investigated fulfils said condition, the subsegment C1 is chosen. The method described above for seeking the most suitable subsegment C, taking account of the regularity P in the signal, is shown in a flow chart in FIG. 2. It is pointed out that this principle for determining the fundamental regularity as well as possible can also be used in the conventional LTP and HLTP techniques. In that case it is then necessary to investigate which correlation values Ri are greater than q * $R_{max}$, where q<1, for example q=0.8. Of the spacings Di, or Di * Ob respectively, associated therewith, the smallest spacing is selected, which is denoted by $D_{optimum}$. $D_{optimum}$ will never be greater than D because, after all, it is the case that $R_{max}>R_{max}$ * q. The invention therefore also relates to a method for coding a sampled analog signal having a repetitive nature, in which, for a signal segment to be coded consisting of a predetermined first number of samples, a search is always made in a preceding subsegment containing a predetermined second number of samples which is greater than the first number of samples for a signal subsegment which agrees as well as possible, by always comparing the signal segment to be coded, in steps of one sample interval, with a subsegment containing the first number of samples which forms part of the subsegment containing the second number of samples, and in which the difference signal is determined between the found, most similar segment and the subsegment to be coded as well as the difference between a reference time instant in the subsegment to be coded and a reference time instant in the found, most similar subsegment, expressed in the number of samples D between the two time instants, characterized in that of the subsegments compared with the segment to be coded that subsegment is chosen as the subsegment with the greatest agreement which has a correlation value R with the samples of the subsegment to be coded for which it is the case that R≧q. $R_{max}$, where q>1 and $R_{max}$ is the maximum correlation value which has been found in correlating the subsegment of the preceding segment and the segment to be coded, and is that subsegment which yields the smallest associated value for D.

Figure 2:
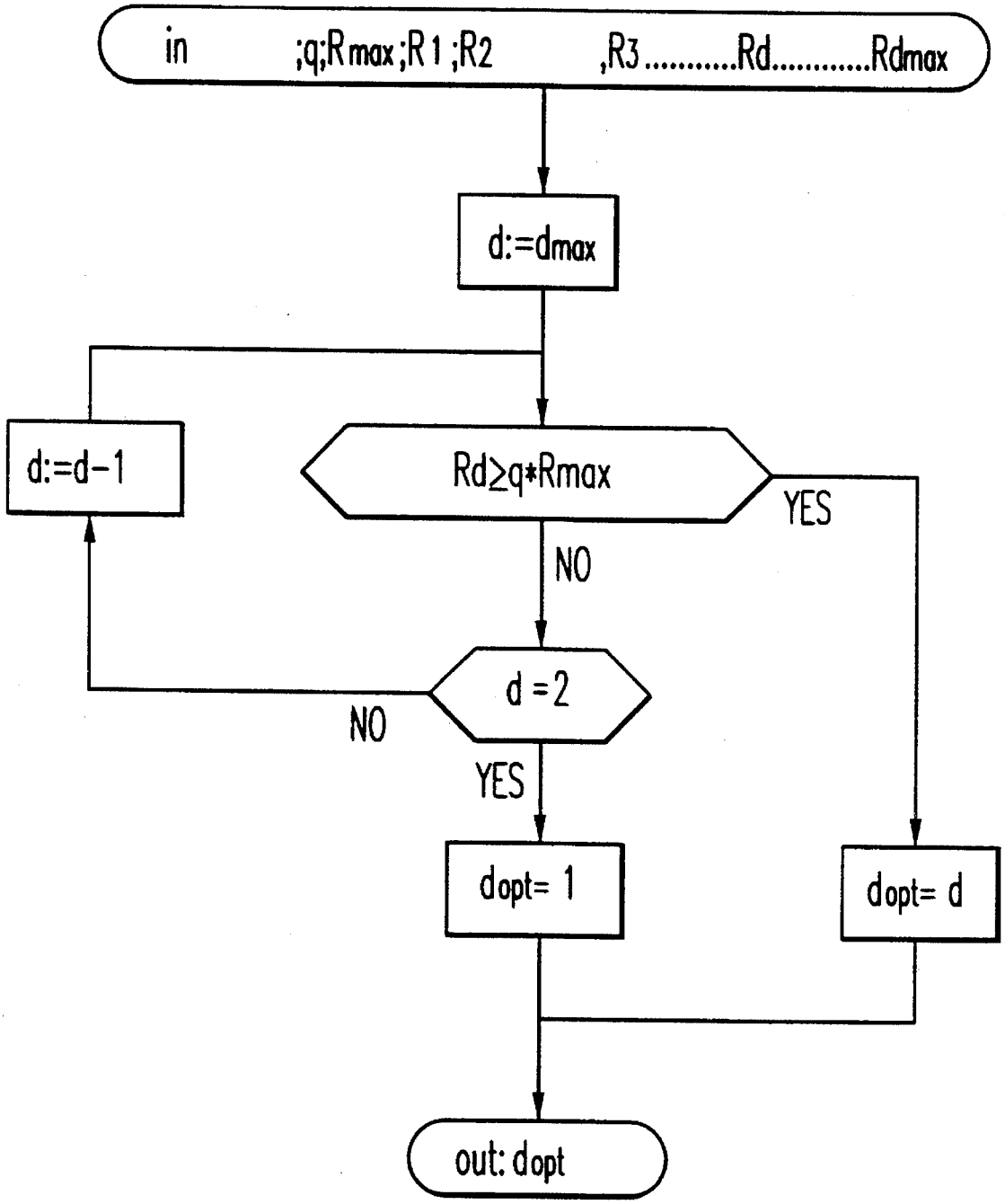
FIG. 2 shows a flow chart to explain an aspect of the invention.

FIG. 2 illustrates the above outlined procedure in terms of a flow chart. The required data are shown at the top. These are the factor q which provides the correlation threshold q*$R_{max}$, which is less than 1 and might for example be 0.8 various correlation values $R_{max}$, which is the maximum correlation value Rd which has been found in correlating the partial (short) segment from the long preceding segment and the segment to be coded.

In the first step shown in FIG. 2, d is set at dmax which corresponds to Rdmax, and after that Rd is compared with q*Rmax to determine whether or not Rd is greater than or equal to the product just mentioned. If so, the value of d that has been set is identified as $d_{opt}$ and that becomes an output of the unit 17 of FIG. 3*a*. If the answer to the above mentioned comparison is negative (Rd<q * Rmax), it is determined whether d=2. If that is not the case (which means it is greater), d is reduced by 1 and the corresponding value of Rd is again subjected to the question of whether or not it is equal to or greater than the product of q and Rmax. If so, the new value of d is identified as $d_{opt}$ and that goes as an output. If the last comparison has a negative result, there is once again a comparison with d=2 and if the answer to that is negative d is reduced again, and so on. If d=2 is found while Rd is still smaller than q * Rmax, then $d_{opt}$ is set equal to 1 that goes out as an output of the unit 17 of FIG. 3*a;*

DESCRIPTION OF AN EXEMPLARY EMBODIMENT OF THE APPARATUS OF THE INVENTION

Figure 3A:
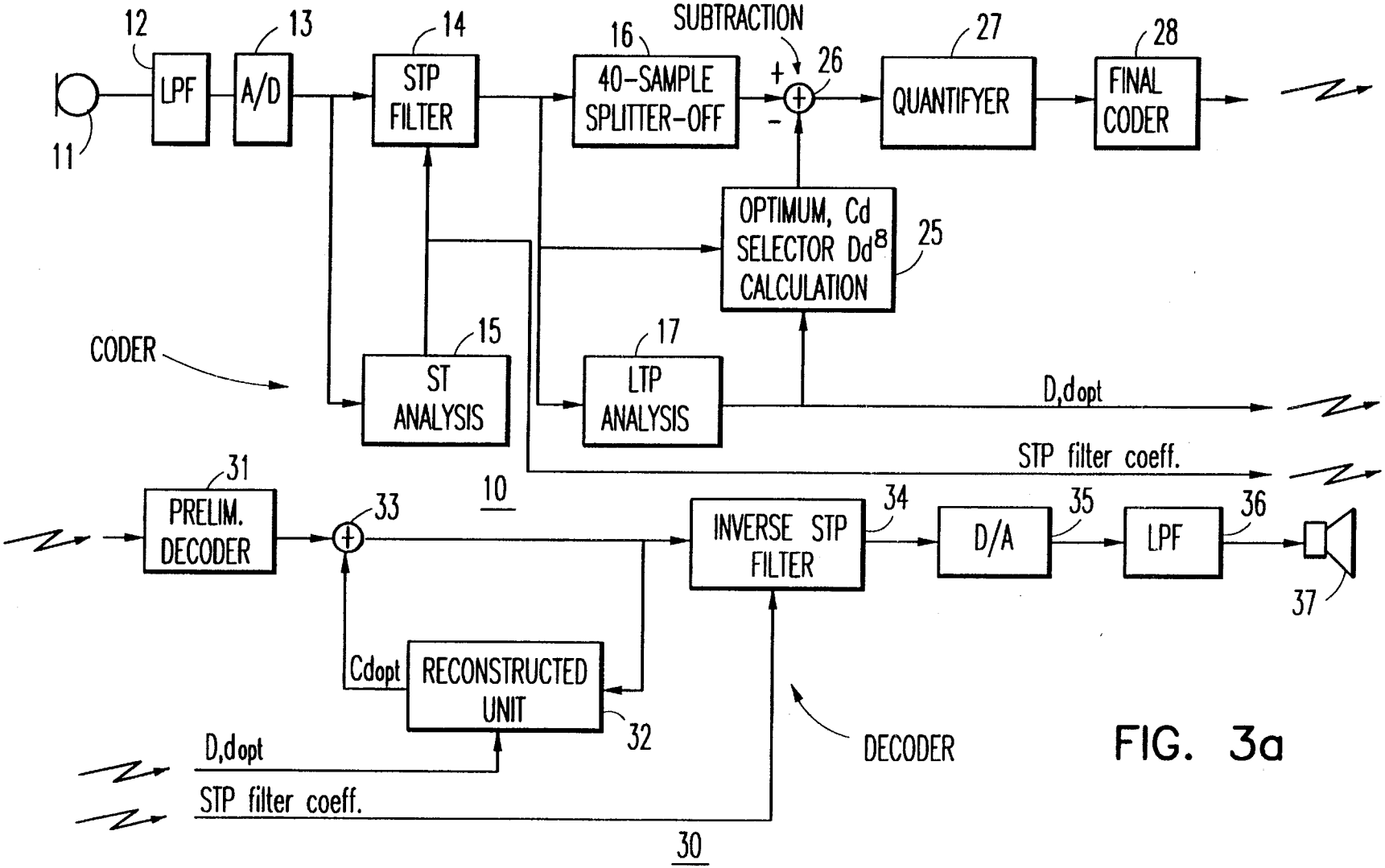
FIG. 3*a* together with FIG. 3*b* provides a block diagram of an exemplary embodiment of a device according to the invention.

FIG. 3*a* shows a block diagram of a coding/decoding system for carrying out the method according to the invention in the case of a speech signal comprising a coding unit 10 and a decoding unit 30. An analog signal delivered by a microphone 11 is limited in bandwidth by a low pass filter 12 and converted in an analog/digital convertor into a series of sampled values which are representative of the analog signal. The output signal of the convertor 13 is fed to the inputs of a short-term prediction filter 14 and of a short-term analysis unit 15. These two units provide the above-mentioned short-term prediction and the analysis unit 15 provides an output signal in the form of short-term prediction filter coefficients, which output signal is transmitted to the decoder 30. The structure and the operation of the filter 14 and the unit 15 are well known to those skilled in the field of speech coding and are not of further importance for the essence of the present invention, so that a further explanation can be omitted.

The output signal of the filter 14, which consists of a series of equidistant samples of the analog input signal, is fed to a circuit 16 in which a pre-determined number (40 samples in the example given above) is always split off from the incoming series of samples, and to a long-term prediction analysis unit 17 in which a part of the method according to the invention is carried out. Said unit 17 is shown in greater detail in FIG. 3*b* and comprises a unit 18 for splitting off the segment A, possibly the output signal of unit 16 can also be used for this purpose, and also a unit 19 for splitting off the subsegment B. The output signals of the units 18 and 19 are fed to a circuit 20 in which the correlation value $R_{c1}$ is calculated for the subsegment C1 in the manner outlined above and also the value of D is determined. The calculated value of D is transmitted to the decoder 30 and is also fed to a unit 21 which is designed to calculate the different values of Dd on the basis of the pre-chosen values for d and Ob. The value of Dd and the subsegment B are fed to a unit 22 for the purpose of calculating the subsegments Cd. The calculated Cd's are fed to a circuit 23 which calculates with the aid of formula (1) the correlation values $R_{cd}$ for the different subsegments Cd on the basis of the segment A also fed to it. In a circuit 24, the correlation values $R_{c1}$ and $R_{cd}$ are compared with one another (see also FIG. 2), and $d_{optimum}$ is determined in the manner described above and transmitted to the decoder.

The optimum subsegment Cd determined in the unit 25 is subtracted sample by sample from corresponding samples of the segment A in a subtraction unit 26 and the resultant difference signal is quantified in a manner known per se in a unit 27 and coded in a unit 28 in order to be transmitted to the decoding unit 30.

Figure 3B:
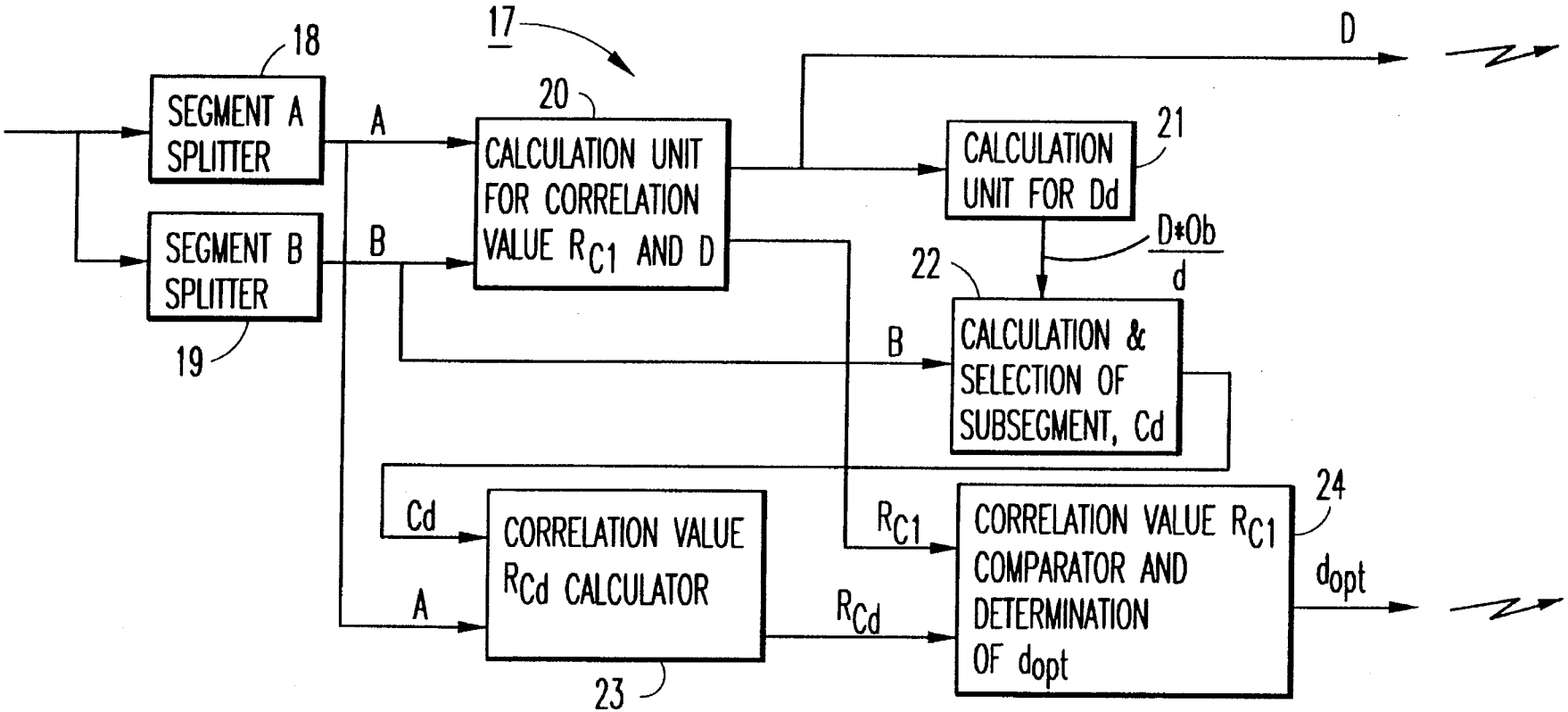
FIG. 3*b* is a more detailed block diagram of block 17 of FIG. 3*a;*

In the decoding unit 30 (FIG. 3*a*) the difference signal received is decoded in a decoder 31 while the subsegment $Cd_{opt}$ is reconstructed in a unit 32 from the received values of D and $d_{opt}$ and from the previously received and reconstructed signal segment B. In an adder 33, the decoded difference signal and the subsegment $Cd_{opt}$ are added sample by sample in order thus to reconstruct the segment A. The reconstructed subsegment A and the received short-term prediction filter coefficients are fed to an inverse short-term prediction filter 34 which reconstructs the transmitted signal samples as well as possible in a manner known per se. The output signal of the filter 34 is converted in a digital/analog convertor 35 into an analog signal which is fed to a loudspeaker 37 via a low pass or band filter 36. The unit 21 of FIG. 3*b* is shown in greater detail in FIG. 4. It comprises a buffer 40, coupled to a unit 21 for receiving the value of D from the unit 20 of FIG. 3*b*. An output of buffer 40, being loaded with the value of D, is coupled to a first input of a multiplicating unit 42, of which a second input is coupled to an output of register 41. Register 41 stores the value of Ob, which can be entered therein by means not shown. The multiplicating unit 42 generates a value of (D * Ob) at its output, which is coupled to a first input of dividing unit 43. A second input of dividing unit 43 is coupled to an output of buffer 44, which is loaded with a value of d. An input of buffer 44 for receiving this value of d is coupled to an output of generator 45. Generator 45 generates this value of d, that being equal to 2, 3, . . . n. The value of n is supplied to an input of generator 45, which input is coupled to an output of register 46. This register 46 stores the value of n, which can be entered therein by means not shown. Dividing unit 43 generates the values of Dd=((D, Ob)/d) for d=2, 3, . . . n at its output, which is furnished as an output of the entire unit 21 for generating these values Dd one after another. They may be referred to as $D_2$, $D_3$, . . . $D_n$.

Figure 4:
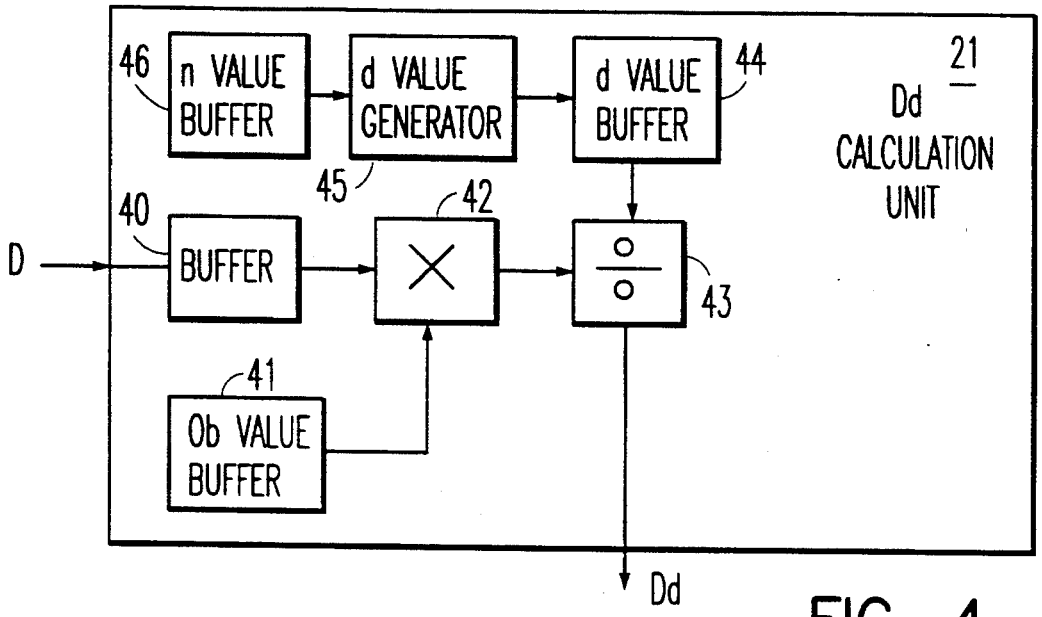
FIG. 4 shows a block diagram of an exemplary embodiment of the unit 21 of FIG. 3*b*.

The function of unit 21 shown in FIG. 4 is as follows. As previously described, unit 20 determines the subsegment C1 lying within subsegment B as being most similar to subsegment A. This subsegment C1 is defined at the hand of the value of D, which is supplied to the input of unit 21. Unit 21 then calculates the values of Dd=((D * Ob)/d) for d=2,3, . . . ,n or in other words the values D2,D3, . . . , Dn, which are supplied one after another at the output of unit 21 and sent to unit 22, which is shown in greater detail in FIG. 5.

The unit 22 comprises a first input coupled to the output of unit 21 for receiving the values of D2, D3, . . . Dn and also a second input for receiving all of the sample of segment B from unit 19 of FIG. 3*b*. Unit 22 includes a buffer memory 50, of which an input is coupled to the second input of the unit 22 for receiving the samples of segment B, which samples are loaded into the buffer 50 at addresses having a mutual distance Ob. This spacing of the addresses of the incoming samples corresponds to the insertion of (Ob−1) samples having a value equal to zero between every two consecutive samples of segment B. The connection for the input addresses for the segment B samples is not shown in FIG. 5 and could be a resettable counter within the buffer 50 advanced by the necessary address spacing as successive samples are stored.

An output of buffer 50 is coupled to an input of buffer 55 for receiving and storing a fixed number of these samples of segment B. The output of buffer 55 is coupled to an input of an interpolating unit 56, which calculates an interpolation value for the fixed number of these samples of segment B. An output of interpolation unit 56 is coupled to an input of buffer 57 for receiving and storing the interpolation value in buffer 57. The fixed number of samples required for an interpolation, referred to hereinafter as (2k+l), in which k is a small positive integer for example 3. The advantages of the invention are not limited to be use of any particular type of interpolation.

The above cited article by J. S. Marques and others describes an appropriate method of interpolation for the present example, in the first column of the second page of that article, with refrence to equations (4), (5), and (6) there set forth. The basis for that method is explained in the last half of the second column of the preceding (first) page.

The unit 22 further includes a subtracting unit 51 of which a first input is coupled through the first input of the unit 22 for receiving the values of D2, D3, . . . Dn from unit 21.

A second input of subtracting unit 51 is coupled to an output of a generator 52 for which generates, in the case of the segment B having 40 samples, values i of which are 120 * Ob, 121 * Ob, . . . 159 * Ob. For all values D1, D2, . . . Dn of Dd, the subtracting unit 51 calculates the following quantities (multiplication now being shown by the letter x instead by a *);

---

(120 × Ob) − Dd,
(121 × Ob) − Dd,
. . . ,
(159 × Ob) − Dd,
In other words this particular sequence can be expressed as:
(120 × Ob) − D2,
(121 × Ob) − D2,
. . . ,
(159 × Ob) − D2,
(120 × Ob) − D3,
(121 × Ob) − D3,
. . . ,
(159 × Ob) − D3, -continued . . . ,
(120 × Ob) − Dn,
(121 × Ob) − Dn,
. . . ,
(159 × Ob) − Dn.

All these values are supplied one after another to a first input of adding unit 53, of which a second input is coupled to an output of generator 54 generates the following 2k+1 values: (−k*Ob); ((−k+l),Ob), . . . , 0, (1*Ob), . . . , ((k−1)*Ob),(k*Ob). These 2k+1 values are, one after the other, added to each value generated by subtracting unit 51.

The first input of unit 22 is further coupled to an input of a correcting unit 58, of which an output is coupled to a third input of adding unit 53, as well as to another input of the above mentioned interpolating unit 56. The correcting unit 58 calculates for each Dd a correction value Sd in such a way that the value of (Dd+Sd) is a multiple of Ob with the further restriction that the relation $(-Ob/2) \leqq Sd \leqq (Ob/2)$ must be satisfied. Interpolating unit 56 needs the correction value Sd for the interpolation, for any interpolation method used by it.

Figure 5:
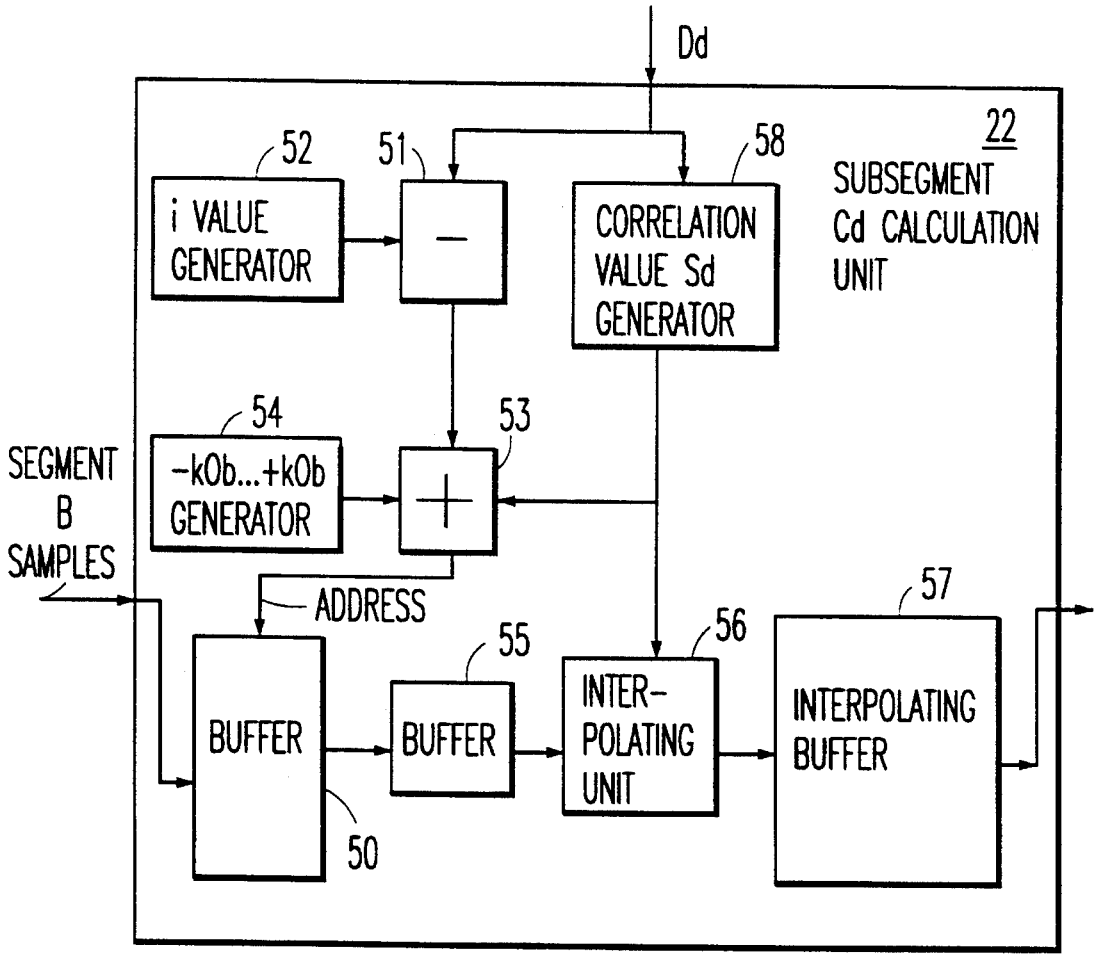
FIG. 5 shows a block diagram of an exemplary embodiment of the unit 22 shown in FIG. 3*b*.

An output of adding unit 53 is coupled to an address input of the buffer 50 shown in FIG. 5, at which the following addresses will arrive (in this particular example) in which addresses an x (instead of *) is used to denote multiplication:

(120 × Ob) − D2 + (−k × Ob) − S2,
(120 × Ob) − D2 + ((−k + 1) × Ob) − S2,
. . . ,
(120 × Ob) − D2 − S2,
(120 × Ob) − D2 + (1 × Ob) − S2,
. . . ,
(120 × Ob) − D2 + (k × Ob) − S2,
(121 × Ob) − D2 + (−k × Ob) − S2,
(121 × Ob) − D2 + ((−k + 1) × Ob) − S2,
. . . ,
(121 × Ob) − D2 − S2,
(121 × Ob) − D2 + (1 × Ob) − S2,
. . . ,
(121 × Ob) − D2 + (k × Ob) − S2,
. . . ,
(159 × Ob) − D2 + (−k × Ob) − S2,
(159 × Ob) − D2 + ((−k + 1) × Ob) − S2,
. . . ,
(159 × Ob) − D2 − S2,
(159 × Ob) − D2 + (1 × Ob) − S2,
. . . ,
(159 × Ob) − D2 + (k × Ob) − S2,
(120 × Ob) − D3 + (−k × Ob) − S3,
(120 × Ob) − D3 + ((−k + 1) × Ob) − S3,
. . . ,
(120 × Ob) − D3 − S3,
(120 × Ob) − D3 + (1 × Ob) − S3,
. . . ,
(120 × Ob) − D3 + (k × Ob) − S3,
(121 × Ob) − D3 + (−k × Ob) − S3,
(121 × Ob) − D3 + ((−k + 1) × Ob) − S3,
. . . ,
(121 × Ob) − D3 − S3,
(121 × Ob) − D3 + (1 × Ob) − S3,
. . . ,
(121 × Ob) − D3 + (k × Ob) − S3,
. . . ,
(159 × Ob) − D3 + (−k × Ob) − S3,
(159 × Ob) − D3 + ((−k + 1) × Ob) − S3,
. . . ,
(159 × Ob) − D3 − S3,
(159 × Ob) − D3 + (1 × Ob) − S3,
. . . ,
(159 × Ob) − D3 + (k × Ob) − S3,
. . . ,
(120 × Ob) − Dn + (−k × Ob) − Sn,
(120 × Ob) − Dn + ((−k + 1) × Ob) − Sn,

-continued

. . . ,
(120 × Ob) − Dn − Sn,
(120 × Ob) − Dn + (1 × Ob) − Sn,
. . . ,
(120 × Ob) − Dn + (k × Ob) − Sn,
(121 × Ob) − Dn + (−k × Ob) − Sn,
(121 × Ob) − Dn + ((−k + 1) × Ob) − Sn,
. . . ,
(121 × Ob) − Dn − Sn,
(121 × Ob) − Dn + (1 × Ob) − Sn,
. . . ,
(121 × Ob) − Dn + (k × Ob) − Sn,
. . . ,
(159 × Ob) − Dn + (−k × Ob) − Sn,
(159 × Ob) − Dn + ((−k + 1) × Ob) − Sn,
. . . ,
(159 × Ob) − Dn − Sn,
(159 × Ob) − Dn + (1 × Ob) − Sn,
. . . ,
(159 × Ob) − Dn + (k × Ob) − Sn.

The function of unit 22 shown in FIG. 5 is as follows. As previously described, unit 19 of FIG. 3*b* is loaded with all samples of segment B, which are also loaded into the buffer memory 50 of unit 22. The following operations take place.

2k+1 of these samples (the fixed number of samples) bridging (i.e. disposed around) the address 120×Ob-D2-S2 are read out of buffer 50 and put into buffer 55. Then interpolating unit 56 calculates the interpolation value belonging to these 2k+1 samples and this interpolation value is stored in buffer 57 at the address 0;

Then 2k+1 of the segment B bridging the address 121×Ob−D2+S2 are read out of buffer 50 and put into buffer 55. Then interpolating unit 56 calculates the interpolation value belonging to these 2k+1 samples and this second interpolation value is stored in buffer 57 at the address 1;

Then 2k+1 of the samples of segment B bridging the address 122×Ob−D2S2 are read out buffer 50 and stored into buffer 55, interpolating unit 56 calculates the interpolation values belonging thereto and this third interpolation value is stored into buffer 57 at the address 2, and so on, until 40 interpolation values are stored. These 40 interpolation values together constitute the subsegment C2 and as such are supplied to the unit 23 of FIG. 3*b*.

Then:

2k+1 of the samples of segment B bridging the address 120×Ob-D3-S3 are read out of buffer 50 and put into buffer 55, interpolating unit 56 calculates the interpolation value belonging to these 2k+1 samples and this interpolation value is stored in the buffer 57 at the address 0;

Then 2k+1 of the samples of segment B bridging the address 121×Ob-D3-S3 are read out of buffer 50 and put into buffer 55, interpolating unit 56 calculates the interpolation value belonging to these 2k+1 samples, and this interpolation value is stored in buffer 57 at the address 1;

Then 2k+1 of the samples of segment B bridging the address 122×Ob-D3-S3 are read out of buffer 50 and put into buffer 55, interpolating unit 56 calculates the interpolation value belonging to these 2k+1 samples, and this interpolation value is stored in buffer 57 at the address 2, and so on until 40 interpolation values are stored. These 40 interpolation values constitute subsegment C3 and are then supplied to unit 23 of FIG. 3*b*.

Then subsegment C4 is formed and stored, and so on until finally subsegment Cn is formed, as follows;

2k+1 of the samples of segment B bridging the address 120×Ob-Dn-Sn are read out of buffer 50 and put into buffer 55, interpolating unit 56 calculates the interpolation value belonging to these 2k+1 samples, and this interpolation value is stored in buffer 57 at the address 0;

2k+1 of the samples of segment B bridging the address 121×Ob-Dn-Sn are read out of buffer 50 and put into buffer 55, interpolating unit 56 calculates the interpolation value belonging to these 2k+1 samples and this interpolation value is stored in buffer 57 at the address 1;

Then 2k+1 of the samples of segment B bridging the address 122×Ob-Dn-Sn are read out of buffer 50 and put into buffer 55, interpolating unit 56 calculates the interpolation value belonging to these 2k+1 samples and this interpolation value is stored in buffer 57 at the address 2, and so on, until 40 interpolation values are stored. These 40 interpolation values constitute segment Cn and are then supplied to unit 23 of FIG. 3*b*.

Subsequently, a new subsegment A and a new subsegment B are loaded into units 18 and 19 of FIG. 3*b*, the value of D is supplied to unit 21, the new segment B is supplied to unit 22 and the units 21 and 22 can repeat the above described operations.

Of course FIGS. 4 and 5 are exemplary embodiments. It is for example possible to omit buffer 55 and to read 2k+1 samples one after another out of buffer 50 into interpolating unit 56, if this interpolating unit 56 is capable of directly calculating a part of the interpolation value as soon as one sample is available.

It would therefore be seen that although the invention has been described with reference to particular examples of methods and apparatus, variations and modifications are possible within the inventive concept.

We claim:

1. A method for coding a sampled analog signal having a repetitive nature, in which, for every signal segment A to be coded, including a predetermined first number of samples, a search is always made in a preceding signal segment B which proceeds said signal segment A to be coded, for a signal subsegment C lying inside said preceding signal segment B and which signal subsegment C is most similar to said signal segment A to be coded, said preceding signal segment B including a predetermined second number of samples which is greater than said first number of samples, said subsegment C including a number of samples equal to said first number of samples, said search being made by always comparing the signal segment A to be coded, in steps of one sample interval, with respective corresponding signal subsegments C of said preceding signal segment B, and wherein a difference signal is obtained by comparing said most similar signal subsegment and the signal segment A to be coded as well as the difference between a reference time instant in the signal segment A to be coded and a reference time instant in said most similar subsegment, expressed in the number D of samples between said respective reference time instants, the method comprising the steps of:

increasing said first number of samples in said signal segment A to be coded by placing (Ob-1) samples having a value equal to 0 between every two consecutive original samples of said signal segment A to be coded;

increasing said second number of samples in said preceding signal segment B by placing (Ob-1) samples having a value equal to 0 between every two consecutive original samples of said preceding signal segment B, said steps of increasing the number of samples being hereinafter referred to as oversampling;

conducting a search to find signal subsegments Cd, each signal subsegment Cd comprising said increased first number of samples and each signal subsegment Cd lying inside said preceding signal segment B comprising said increased second number of samples, for which subsegments Cd it is the case that the number of samples Dd, expressed in the number of samples after oversampling which lie timewise between said reference time instant in said signal segment A to be coded and said reference time instant in a signal subsegment Cd, fulfills the relation Dd=(D*Ob)/d, in which d=2, 3, 4 . . . n, wherein n is a positive integer and Ob and n are chosen in each case in a manner such that Dd is always an integer;

prior to said step of comparing said signal segment A to be coded with signal subsegments Cd, each one including of said increased first number of samples and each one lying inside said preceding signal segment B, including said increased second number of samples, sample values between non-zero samples of signal subsegments Cd are changed by an interpolation technique at predetermined timewise positions, which predetermined timewise positions are situated at respective spacings Dd from the original samples in said segment A to be coded that were present before its first number of samples was increased; and searching for a signal subsegment Cd which is most similar to said signal segment A to be coded is performed with signal subsegments Cd having values changed by said interpolation technique at said predetermined timewise positions.

2. The method of claim 1, wherein the comparison between said signal segment A to be coded and each one of said signal subsegments Cd is also carried out for signal subsegments for which Dd=(D*Ob)/d+eps, where eps is equal to at least a portion of the values in the range eps=−(Ob−1) . . . −2, −1, 0, 1, 2 . . . (Ob−1).

3. The method of claim 1, comprising choosing as the most similar signal subsegment Cd that signal subsegment Cd which has a correlation value Rd with the samples of the signal segment A to be coded for which $R \geqq q*R_{max}$, where $q<1$ and $R_{max}$ is the maximum correlation value which has been found in correlating each one of said signal subsegments Cd with said signal segment A to be coded, and is that signal subsegment Cd which yields a smallest associated value for D.

4. A method for coding a sampled analog signal having a repetitive nature, in which, for every signal segment A to be coded, including of a predetermined first number of samples, a search is always made in a preceding signal segment B which proceeds said signal segment A to be coded, for a signal subsegment C lying inside said preceding signal segment B and which signal subsegment C is most similar to said signal segment A to be coded, said preceding signal segment B having a predetermined second number of samples which is greater than said first number of samples, said signal subsegment C having a number of samples equal to said first number of samples, said search being made by always comparing the signal segment A to be coded, in steps of one sample interval, with respective corresponding signal subsegments C of said preceding signal segment B, and wherein a difference signal is obtained by comparing said most similar signal subsegment and the signal segment A to be coded as well as the difference between a reference time instant in the signal segment A to be coded and another reference time instant in said most similar signal subsegment, expressed in the number D of samples between said respective reference time instants, the method comprising the steps of:

choosing a signal subsegment C, among said signal subsegments C lying inside said preceding signal segment B compared with said segment A to be coded, which chosen signal subsegment C has a correlation value Rd with the samples of said segment A to be coded, for which $Rd \geqq q*R_{max}$, where $q<1$ and $R_{max}$ is the maximum correlation value which has been found in correlating each one of said signal subsegments Cd with said signal segment A to be coded, said chosen signal subsegment C being also a one which yields a smallest associated value for D, among those for which said relation holds.

5. A device for coding an analog signal having a repetitive nature, comprising:

sampling means for sampling an analog signal to be coded;

first splitting off means, coupled to said sampling means, for splitting off a signal segment A to be coded, which contains a predetermined first number of samples;

second splitting off means, coupled to said sampling means, for splitting off a preceding signal segment B, which proceeds said signal segment A to be coded and which preceding signal segment B contains a predetermined second number of samples greater than said first number of samples;

comparing means, coupled to said first splitting off means and to said second splitting off means, for always comparing, in steps of one sample interval, sample values of said signal segment A to be coded with corresponding sample values of a signal subsegment C which lies inside a preceding signal segment B and which signal subsegment C contains said first number of samples, for several signal subsegments C shifted in time from one to the next by one sample interval;

selecting means, coupled to said comparing means, for selecting a signal subsegment C which shows a greatest similarity to said signal segment A to be coded;

first determining means, coupled to said selecting means, for determining a signal which is representative of a difference between said signal segment A to be coded and said selected signal subsegment C;

second determining means, coupled to said selecting means, for determining a number of samples D between a reference time instant in said signal segment A to be coded and another reference time instant in said selected signal subsegment C;

first oversampling means, coupled to said first splitting off means, for oversampling said signal segment A to be coded by inserting a predetermined number of samples between every two consecutive original samples;

second oversampling means, coupled to said second splitting off means, for oversampling said preceding signal segment B by inserting a predetermined number of samples between every two consecutive original samples;

third determining means, coupled to said second determining means, for determining a value $Dd=(D*Ob)/d$, where $d=2, 3, 4 \ldots n$, where n is a positive integer, and where Ob is an integer representative of a magnitude of oversampling;

fourth determining means, coupled to said second oversampling means and to said third determining means, for determining signal subsegments Cd, each one including said increased first number of samples and each one lying inside said preceding signal segment B including of said increased second number of samples, for which signal subsegments Cd the number of samples Dd, expressed in the number of samples after oversampling which lie timewise between said reference time instant in said signal segment A to be coded and said another reference time instant in a signal subsegment Cd, fulfills the relation $Dd=(D*Ob)/d$, where $d=2, 3, 4 \ldots n$, where n is a positive integer, and where Ob and n are chosen such that Dd is always an integer, by means of interpolation; and means, coupled to said fourth determining means, for changing sample values between non-zero samples of signal subsegments Cd by an interpolation technique at predetermined timewise positions, which predetermined timewise positions are situated at respective spacings Dd from the original samples in said signal segment A to be coded that were present before its first number of samples was increased.

* * * * *